United States Patent [19]

Fischer et al.

[11] Patent Number: 4,727,812

[45] Date of Patent: Mar. 1, 1988

[54] PAYLOAD PROJECTILE FOR EJECTABLE SECONDARY AMMUNITION

[75] Inventors: Siegmar Fischer; Günter Sikorski, both of Düsseldorf, Fed. Rep. of Germany

[73] Assignee: Rheinmetall GmbH, Düsseldorf, Fed. Rep. of Germany

[21] Appl. No.: 48,684

[22] Filed: May 12, 1987

[30] Foreign Application Priority Data

May 15, 1986 [DE] Fed. Rep. of Germany ..... 3616410

[51] Int. Cl.[4] ..... F42B 41/00

[52] U.S. Cl. ..... 102/481; 102/293; 102/473

[58] Field of Search ..... 102/293, 473, 489, 499, 102/500, 481, 202.1

[56] References Cited

U.S. PATENT DOCUMENTS 3,173,364 3/1965 Nordzell ..... 102/481

3,665,857 5/1972 Radnich et al. ..... 102/481

FOREIGN PATENT DOCUMENTS 2131748 12/1972 Fed. Rep. of Germany ..... 102/473

*Primary Examiner*—Harold J. Tudor

*Attorney, Agent, or Firm*—Spencer & Frank

[57] ABSTRACT

A payload projectile including a carrier body having an ogival region in which a receptacle for an ejection charge is provided. A perforated disc is seated immediately in front of the receptacle and a lifting ring screw closes an opening in the carrier body at the forward tip of the ogival region. A chamber, reserved for an igniter, is defined between a rear face of the screw and a front face of the disc and has radial dimensions wider than those of the seat of the disc so that the disc is movable forwardly toward the screw peripherally unimpeded in the chamber. The lifting ring screw is provided with a passage at least partially filled with a melting fuse and projections on the rear face of the screw so as to project into or in the immediate vicinity of the chamber, thereby to ensure that upon inadvertent ignition of the ejection charge in the absence of the igniter, upon movement of the disc toward the screw as a result thereof, hot gases from the ejection charge are able to pass along a path defined through and around the disc, melt the fuse and pass out of the carrier body without building up such internal pressure as might cause ejection of secondary ammunition provided rearwardly of the ejection charge.

4 Claims, 2 Drawing Figures

PAYLOAD PROJECTILE FOR EJECTABLE SECONDARY AMMUNITION

BACKGROUND OF THE INVENTION

The present invention relates to a payload projectile, and more particularly to a payload projectile which includes a carrier for an ejectable payload, such as explosive secondary ammunition.

In one type of such a payload projectile, a supporting carrier body has an ogival region provided with a circularly cylindrical or frustoconical chamber for an ejection charge, an axially centrally perforated disc and a chamber for an igniter for actuating the ejection charge, the tip of the supporting body being closed by a lifting ring screw which includes a melting fuse and is sealed by a gasket fixed by the screw. Immediately in front of the ejection charge is a seat for seating the disc. The chamber for the igniter is in the ogival region just forward of the disc. This chamber is defined at its front and rear by the frontal face of the disc and the rear face of the lifting screw, respectively. The rear face of the lifting screw has a passage containing a melting fuse. To be noted is that during storage of the payload projectile at an ammunition depot or during transport, the chamber for the igniter is normally empty for reasons of safety to be explained below.

In a prior payload projectile of this type, the outer surface of the seat for the disc and the peripheral surface of the carrier body immediately forward of the seat which surrounds the chamber for the igniter, have the same radial dimensions, while the rear face of the lifting ring screw is planar. For reasons of safety, no igniter is disposed in the space provided for it, prior to reaching its location of use. To equip the payload projectile with the igniter at its location of use, the lifting ring screw is initially unscrewed, the igniter is inserted and then the lifting ring screw is screwed in again. When the igniter is in place, the disc between igniter and ejection charge serves to protect the igniter; a central bore in the disc, on the one hand, forms an ignition channel for actuating the ejection charge and, on the other hand, protects the igniter during pressure build-up so that the developed pressure is available substantially completely for the ejection process.

While a melting fuse disposed in a passage of the lifting ring screw responds by melting at a temperature of about 95° C., the ignition temperature for the ejection charge lies in a range around 130° C. Nevertheless, in the case of fire or intense solar radiation, inadvertent ejection has occurred in such a prior payload projectile in spite of the absence of the igniter, and the fuse being actuated in time. This has happened because the disc had moved against the planar rear face of the lifting ring screw and the passage cross section of the ignition channel was not sufficient to prevent a buildup of damaging internal pressure.

SUMMARY OF THE INVENTION

It is an object of the present invention to provide a payload projectile of the above-mentioned type in which ejection of the secondary ammunition (payload) in a payload projectile not yet equipped with an igniter is reliably prevented.

This is accomplished by making the chamber reserved for the igniter radially wider than the seat for the disc so that the disc is not impeded in its axial movement in the direction toward the rear face of the lifting ring screw, and providing in the chamber or the immediate vicinity thereof means to ensure that even after the forward axial movement of the disc, the passage cross section between the ejection charge and the passage in the lifting ring screw freed by melting of the melting fuse is larger than given by the perforation in the disc.

DESCRIPTION OF THE PREFERRED EMBODIMENT

Figure 1:
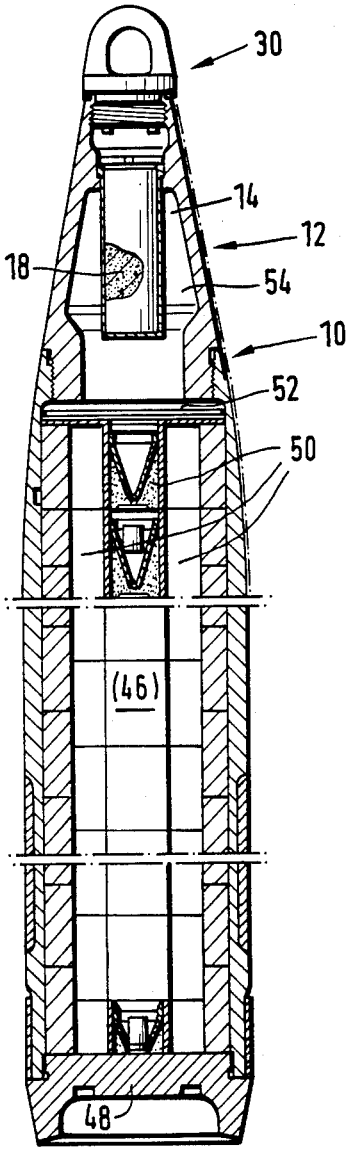
FIG. 1 is a longitudinal axial sectional view of a payload projectile employing the invention.

Referring to FIG. 1, a payload projectile includes a carrier body 10 having an ogival region 12, an ejection disc 52 which subdivides the interior into a frontal pressure chamber 54 and a rearward load chamber 46 to accommodate the secondary ammunition 50 and a discardable section 48. If the internal pressure developing in pressure chamber 54 after actuation of an ejection charge 18 exceeds a given value, a force producing an intentional shear effect is transferred by way of ejection disc 52 and the column formed by secondary ammunition 50 directly to section 48 so as to rearwardly eject the secondary ammunition 50.

Figure 2:
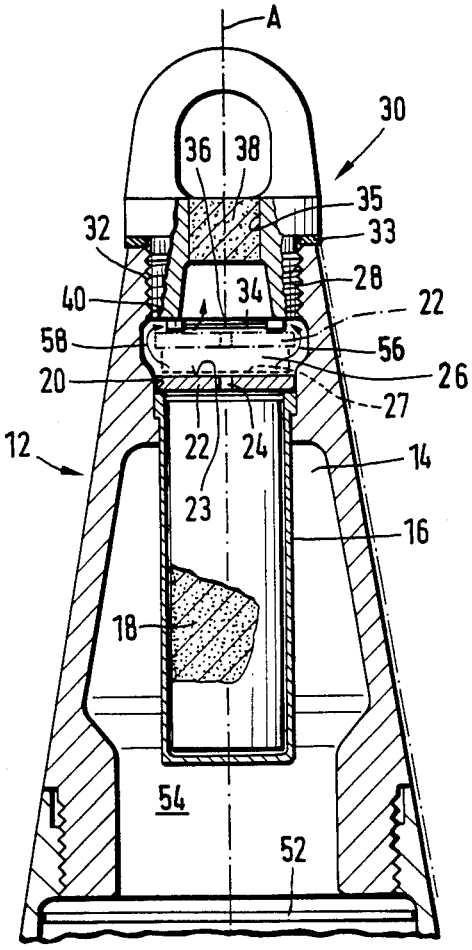
FIG. 2 is an enlarged longitudinal axial sectional view of a front section of the payload projectile of FIG. 1.

FIG. 2 shows, in pressure chamber 54, a receptacle or chamber 14 holding a sleeve 16 for the ejection charge 18, a seat 20 forward of ejection charge 18 for a disc 22 having a central axial bore (ignition channel) 24, a chamber 26 forward of the disc 22 for an igniter 27 (shown in dashed lines) as well as a bore forward of the igniter 27, having an internal thread 28 for a lifting ring screw 30. The lifting ring screw 30 comprises a body having an external thread 32 and an area (not shown in detail) for fixing a gasket 33 at the front end of the carrier body 10, which seals the chamber 26 from the exterior of the projectile between the confronting faces of the screw 30 and the forward end of the carrier body 10. In the rear face 34 of lifting ring screw 30, there is disposed a passage 36 leading to a melting fuse 38 provided in an axial passage 35 in the lifting ring screw 30. Thus, the melting fuse 38 fills part of the overall passage defined by passages 35 and 36. Chamber 26 for igniter 27 has an inner diameter larger than the diameter of outer surface of the seat 20 for disc 22. If, in the absence of igniter 27, ejection charge 18 is inadvertently actuated, a pressure building up in sleeve 16 is able to move disc 22 from seat 20 in the direction of the longitudinal axis A of the projectile forwardly against rear face 34 of lifting ring screw 30. (See the dot-dash illustration of disc 22.) The disc 22 must overcome a given mechanical resistance, such as, for example, a frictional peripheral engagement with the seat 20. Projections 40 on rear face 34 so as to project into or in the immediate vicinity of the chamber 26, ensure that the hot gases flow not only through ignition channel 24 but also around disc 22, as indicated by flow arrows 56 and 58, and are able to escape through the axial passage 35 in the lifting ring screw 30 released by melting of a melting fuse 38 provided in the passage, without pressure being able to build up in pressure chamber 54 which would be sufficient to eject secondary ammunition 50.

The present invention not only ensures, in a very simple manner, that inadvertent ejection of the secondary ammunition is reliably prevented in a payload projectile, it also eliminates the need for any additional manipulations while supplying the payload projectile with the igniter, as such manipulations would not only consume time, particularly under combat conditions, but could also be forgotten.

The present disclosure relates to the subject matter disclosed in West German Patent Application Serial No. P 36 16 410.0, filed May 15th, 1986, the entire specification of which is incorporated herein by reference.

It will be understood that the above description of the present invention is susceptible to various modifications, changes and adaptations, and the same are intended to be comprehended within the meaning and range of equivalents of the appended claims.

We claim:

1. A projectile for an ejectable payload comprising:

a carrier body defining a space for accommodating an ejectable payload and extending in axial direction, said carrier body having an ogival region in a forward end thereof and an opening at a forward tip of the ogival region, said ogival region having therein:

a space accommodating an ejection charge therein;

a disc seat immediately forward of said ejection charge, having a forward extending outer surface portion, said outer surface portion having given radial dimensions;

a disc seated in said seat, said disc having a peripheral surface seated against said outer surface portion of said seat, and a central axially extending bore, said disc having a forwardly facing front face;

a lifting ring screw in said opening so as to close said forward tip of the ogival region, said screw having a passage therein at least partially filled with a melting fuse, and a rearwardly facing rear face;

a chamber reserved for an igniter, defined between said rear face of said screw and said front face of said disc, said chamber having radial dimensions wider than those of said outer surface portion of said seat such that said disc is movable forwardly in said axial direction, peripherally unimpeded in said chamber; and means for ensuring that upon completion of movement of said disc from said seat, a passage of greater cross section than that of said bore is defined from said ejection charge to said melting fuse.

2. A payload projectile as in claim 1, wherein means for ensuring is disposed in said chamber.

3. A payload projectile as in claim 1, wherein said means for ensuring comprises projections on said rear face of said lifting ring screw; said projections being in engagement with said disc upon completion of the movement thereof.

4. A payload projectile as in claim 1, further comprising means for mechanically resisting movement of said disc from said seat.

* * * * *